US006582195B2

(12) United States Patent
Davidson

(10) Patent No.: US 6,582,195 B2
(45) Date of Patent: Jun. 24, 2003

(54) COMPRESSOR ROTOR BLADE SPACER APPARATUS

(75) Inventor: Dwight Eric Davidson, Greer, SC (US)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 09/891,513

(22) Filed: Jun. 27, 2001

(65) Prior Publication Data

US 2003/0002987 A1 Jan. 2, 2003

(51) Int. Cl.[7] ..... F01D 5/30

(52) U.S. Cl. ..... 416/198 A; 416/204 A; 416/219 R

(58) Field of Search ..... 416/193 A, 198 A, 416/204 A, 219 R, 220 R, 221

(56) References Cited

U.S. PATENT DOCUMENTS

| | | | | |
|---|---|---|---|---|
| 3,395,891 A | * | 8/1968 | Burge et al. | 416/220 R |
| 3,653,781 A | * | 4/1972 | Cooper | 416/221 |
| 5,174,720 A | | 12/1992 | Gradl | 416/204 A |
| 5,263,816 A | | 11/1993 | Weimer et al. | |
| 5,509,784 A | | 4/1996 | Caruso et al. | |
| 6,109,877 A | | 8/2000 | Gekht et al. | 416/221 |
| 6,158,102 A | | 12/2000 | Berry et al. | |

* cited by examiner

*Primary Examiner*—Edward K. Look
*Assistant Examiner*—Richard A. Edgar

(57) ABSTRACT

An integral compressor rotor spacer cartridge fits within the dovetail region of the rim of a compressor rotor wheel to retain the dovetail portion of the rotor blade and maintain an angular spaced relationship between the rotor blades. The dovetail portion of the rotor blade is retained in a pocket or notched portion of the spacer cartridge.

21 Claims, 8 Drawing Sheets

COMPRESSOR ROTOR BLADE SPACER APPARATUS

BACKGROUND OF THE INVENTION

The present invention is related to turbomachinery and more particularly, to a spacer apparatus for retaining a compressor rotor blade while improving gas turbine efficiency. Gas turbine engines include a compressor having a compressor rotor comprising a plurality of compressor stages. Air flowing into the compressor is compressed at each stage to such an extent that the pressure after the last few stages can reach approximately seventeen times the atmospheric pressure. Each compressor stage comprises a plurality of rotor blades or buckets mounted to the periphery or rim of a rotor wheel in a spaced relationship between adjacent blades. This spaced relationship is conventionally maintained by spacer blocks mounted on opposing sides of the rotor blade mounted on the rim. A typical compressor rotor can have dozen of rotor blades and multiple dozens of spacer blocks.

Manufacturers of advanced gas turbine engines seek to design and develop engines with increased reliability and reduced life cycle cost. Life cycle cost for users of gas turbine engines is directly related to its efficiency. The life cycle cost can be related to many factors such as, the initial construction, fuel consumption, periodic maintenance, and other cost factors incurred during the life of a gas turbine engine. Thus, any improvement that can reduce life cycle costs is a valuable one. A primary way of reducing life cycle cost is to improve the efficiency of a gas turbine engine, thereby reducing fuel consumption. Another way to reduce life cycle cost is to maximize gas turbine availability via increased reliability, which in turn reduces the maintenance overhaul costs.

Of those factors affecting increases in life cycle cost, the overall airfoil response is important to consider. There are a number of ways to increase airfoil efficiencies. Engine designers can impose small changes to the airfoil leading edge and trailing edge angles, optimize distances between airfoils, impose airfoil leans, and impose airfoil sweep. Another way to increase airfoil operability or efficiencies is to minimize leakages around the airfoil tip and/or dovetail. These leakages or gaps are defined as the distance between the rotor blade tip and the compressor case or machined gaps under the dovetail in relation to rotor wheel rim. Relatively large changes in the radial clearance of the tip or machined dovetail gap in combination with high compression of the air, can prematurely force air to leak around these blade features. Most gas turbine engines are designed with a tolerance level or margin to account for some leakage. In general, an excessively large radial gap lowers the efficiency by increasing air leakage reducing engine performance and increasing fuel consumption. Therefore, it is desirable to minimize these leakages for the engine.

Dovetail slot leakage is a prime factor that affects the engine performance. It has been determined that the amount of machine gaps around and under the airfoil dovetails is far in excess of those gaps existing between the rotor blade tip and the compressor case. When viewed from an engine system standpoint, each compressor stage has dozens of leakage pathways formed between the abutting or interfacing parts of the rotor blade, slot, and spacer blocks. Each engine has dozens of compressor stages that allow these so called cumulative leaks to increase. The result of these leaks is that several tenths of the percent flow are lost and thus fuel consumption is increased. In addition, reducing slot leakage improves the ability to better control the radial tip clearance of the airfoil relative to the compressor case walls.

Manufacturing a conventional compressor rotor can involve numerous man-hours and equipment operation time. Conventionally, the compressor rotor is assembled by stacking compressor stages, one by one, within an axial relationship to each other. A typical compressor stage can weight almost 10,000 pounds. A conventional technique for securing the rotor blades to the rotor wheel is to form flat bottom slot in the wheel rim having a cross-section matching the blade dovetail flat bottom shape. Each blade has a dovetail portion formed with a complementary dovetail feature that interlocks with the dovetail region of the rim to secure the blade to the rotor.

Most blade dovetails in industrial gas turbines are secured in a process call "staking". The assembly process requires the placing of a first dovetail spacer in the wheel rim slot, then placing a rotor blade in the slot of the rim and finally placing a second spacer. These three pieces (e.g., first spacer, rotor blade, and second spacer) are then staked in place by deforming metal material around the blade dovetail with a tool similar to a nail punch. Each of the hundreds of rotor blades and spacer blocks must be manually assembled into the slot of the rotor wheel rim. This process is repeated for each compressor stage, each compressor engine and any repairs that might occur over the life of the engine. This assembly process is time consuming and costly.

Compressor rotors undergo a periodic inspection and overhaul process after a predetermined of number of operating hours. In the inspection and overhaul process, the rotor blades and spacers blocks are removed from the rotor wheel, i.e. the original "stakes" are ground out. This removal and re-staking process can be time consuming and costly. Thus, the cost of constructing a gas turbine and of performing periodic inspections can be reduced, if steps in the assembly process are eliminated.

In seeking to reduce life cycle costs, the cost of retooling and reconfiguring manufacturing operations should be avoided. Due to increased life expectations, rotor wheel designs have been migrating towards a slot in the rim having a rounded bottom geometry instead of a flat bottom geometry. This evolution necessitates retooling equipment and redesigning the dovetail shape of rotor blades in a rounded design. This retooling, both for the slots in the wheel rims and the blade dovetails can be a very costly process and includes such items as reprogramming equipment, designing new manufacturing fixtures, additional compressor stage stacking operations, and discarding the flat bottom dovetail rotor blades. Thus it is desirable to reduce or eliminate, the discarding of flat bottom dovetail blades, and the associated costs of using rounded bottom dovetail blades.

BRIEF SUMMARY OF THE INVENTION

Briefly, the present invention fulfills the need to reduce the life cycle cost by improving efficiency and reducing maintenance cost in a gas turbine engine. Broadly, in one aspect of the invention, a rotor blade spacer apparatus for a compressor comprises a body having a blade retaining portion, and a spacer portion, in which the body includes a dovetail portion for mating engagement with a slot on a compressor rotor wheel. The spacer apparatus fits within the slot of the rim of the rotor wheel to maintain a spaced relationship between adjacent rotor blades and, simultaneously, to retain and hold the dovetail portion of the rotor blade mounted within the spacer apparatus.

In another aspect of the invention, a spacer cartridge enables a rotor blade with a flat or semi-flat bottom geometry dovetail portion to be engaged within a round bottom dovetail slot of the rotor wheel enabling older flat bottom blades to be used in newer rotors. Enabling the use of existing flat bottom blades in rotors with rounded bottom slots provides significant cost savings. The dovetail portion of the rotor blade is retained in a pocket or notched portion of the spacer cartridge. The pocket is configured to retain the entire dovetail portion of the rotor blade. When the spacer cartridge is in use, surfaces of the dovetail portion abut the mating corresponding faces or surfaces of the pocket. The longitudinal face or surface on either side of the dovetail portion bears against a portion of the inner surfaces of the slot in the rim of the rotor wheel.

In one aspect, the present invention reduces the life cycle cost by improving the efficiency of a gas turbine engine because the spacer cartridge provides improved blade tip clearance control by reducing slot leakage in the compressor stage. The small radial clearance between the rotor blade tips and the compressor shroud remains more consistent during operation of the compressor rotor. Thus, less leakage margin is required and the fuel consumption is improved by using the rotor blade spacer apparatus.

In another aspect, the present invention also reduces life cycle cost by reducing the assembly time of the blades to the rotor rim. The spacer cartridge eliminates the assembly of two separate spacers block each of which had to be individually assembled in the rotor wheel rim. In addition, the spacer cartridge reduces waste of material by accurately holding the tip of a rotor blade outward for a tip grinding operation after the blades are on the rotor wheel. Further, the spacer cartridge increases the efficiency of operations and reduces overhead operating costs by reducing the number engineering drawings, and requiring warehousing and inventory control of fewer parts.

DETAILED DESCRIPTION OF THE INVENTION

Figure 1:
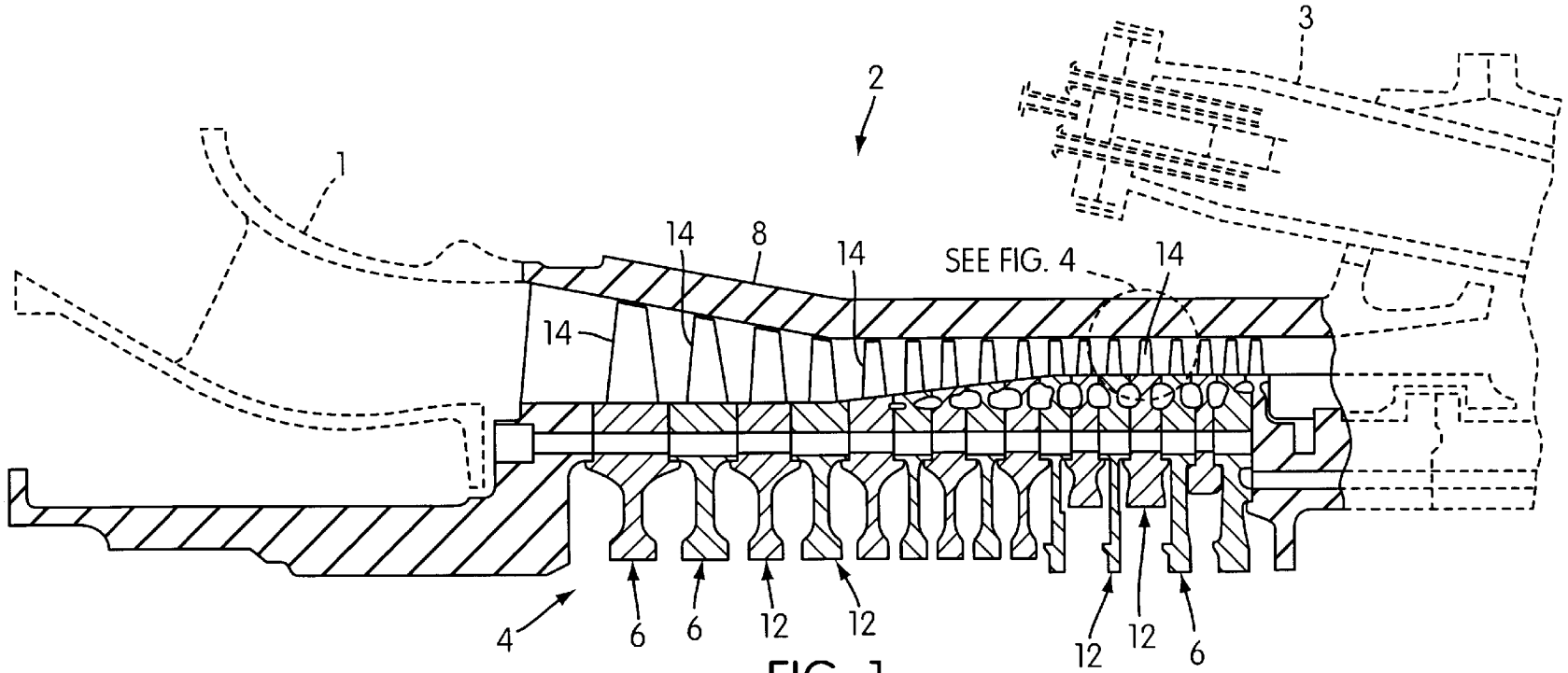
FIG. 1 is a schematic fragmentary side sectional view of a gas turbine engine showing a compressor rotor and compressor stages in a compressor case.
Figure 2:
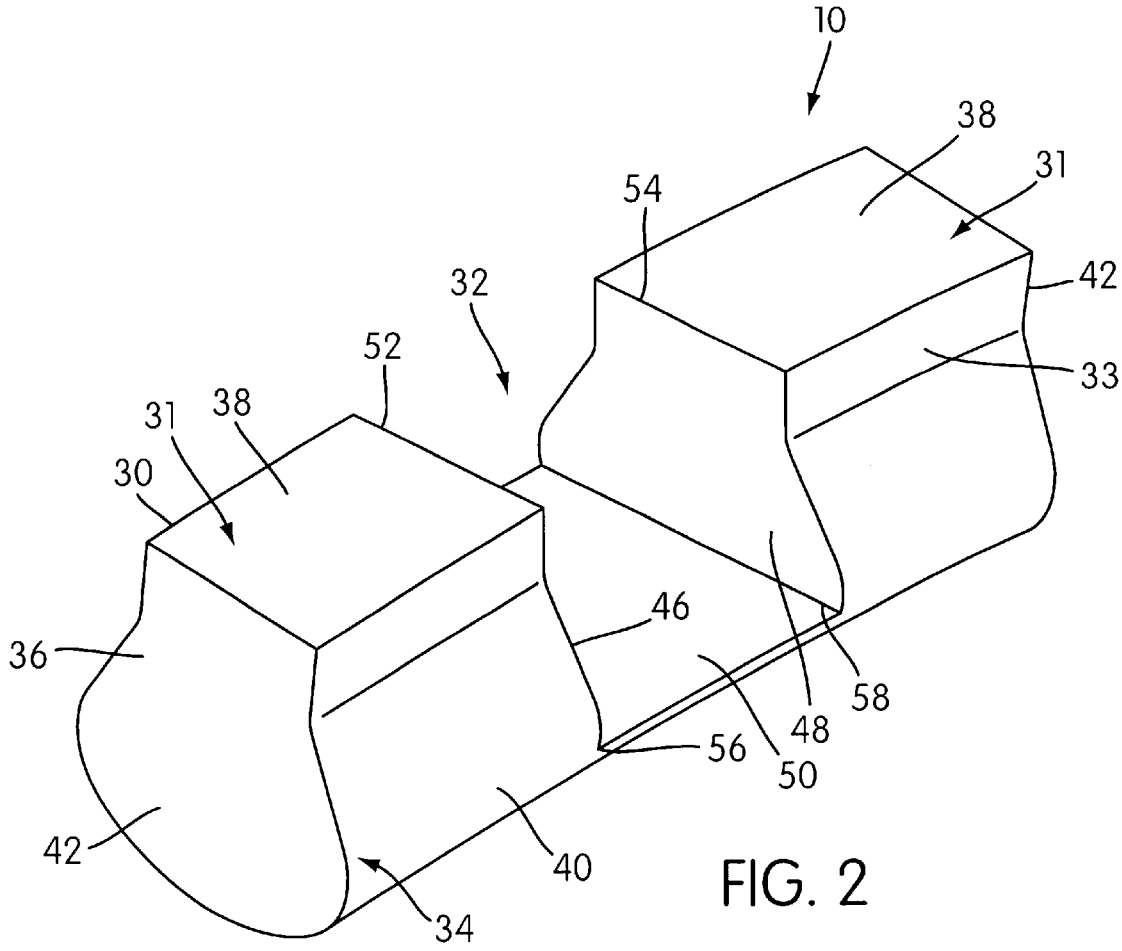
FIG. 2 is a schematic perspective view of a first embodiment of a spacer cartridge.
Figure 3:
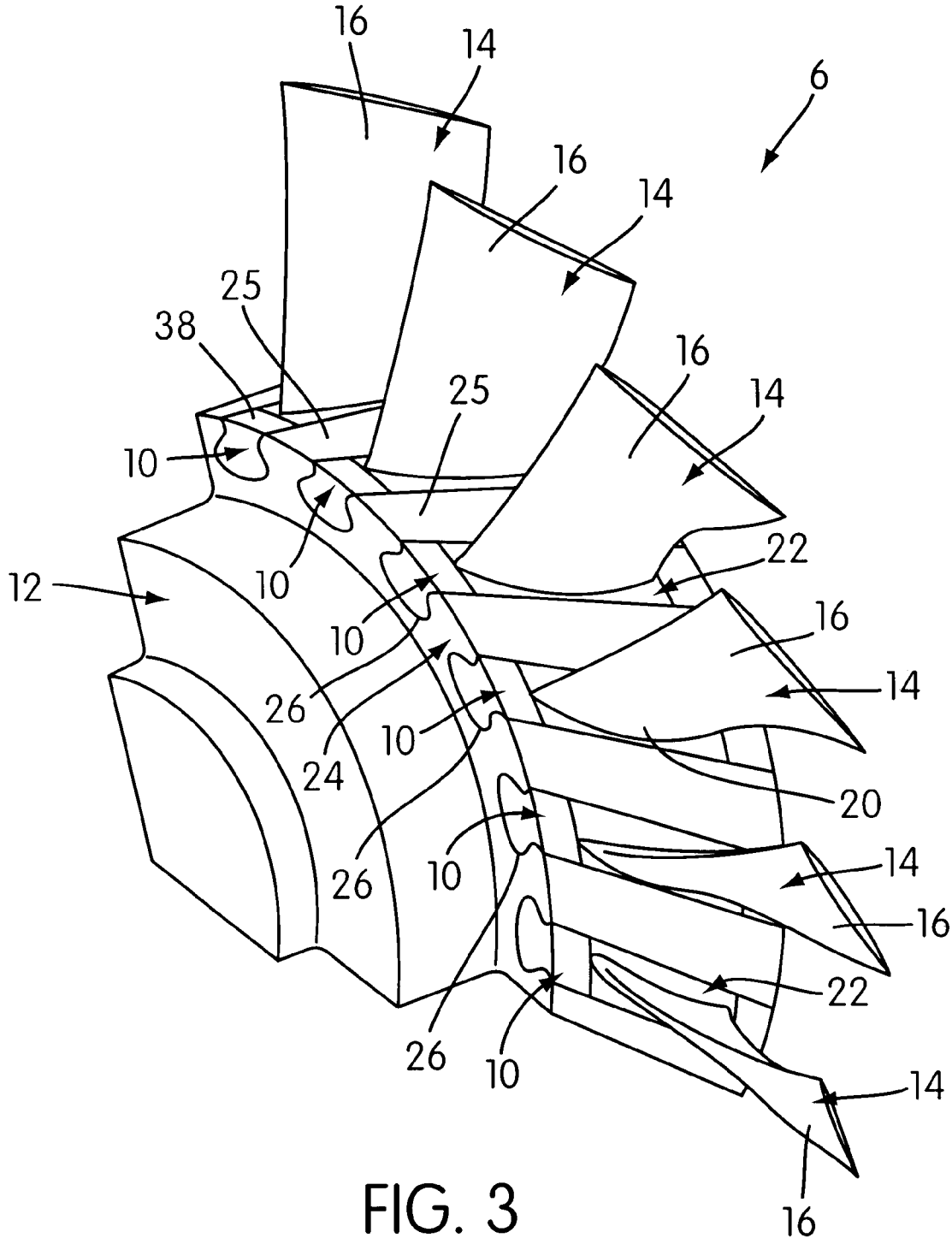
FIG. 3 is a partial sectional perspective view of a compressor rotor stage of FIG. 1.

FIGS. 1–5, illustrate an embodiment of a compressor rotor blade spacer apparatus. The compressor rotor blade spacer apparatus is referred to herein as a spacer cartridge 10. FIG. 1 illustrates a fragmentary side elevational view of a gas turbine engine having an inlet 1 for air to enter, a compressor portion 2, and a combustor 3 for burning an air-gas mixture. The compressor portion comprises a compressor rotor 4 having a series of compressor stages 6 disposed in a tubular compressor case 8. The compressor rotor can include up to seventeen separate stages. As shown in FIG. 3, each compressor stage 6 comprises a rotor wheel or disk 12, a plurality of radially mounted rotor blades 14, and a plurality of spacer cartridges 10 disposed between adjacent rotor blades 14. Each spacer cartridge 10 is designed to retain and hold each rotor blade 14 therein. In contrast, conventional assemblies required separate spacer blocks assembled between rotor blades mounted on the rotor wheel.

Figure 4:
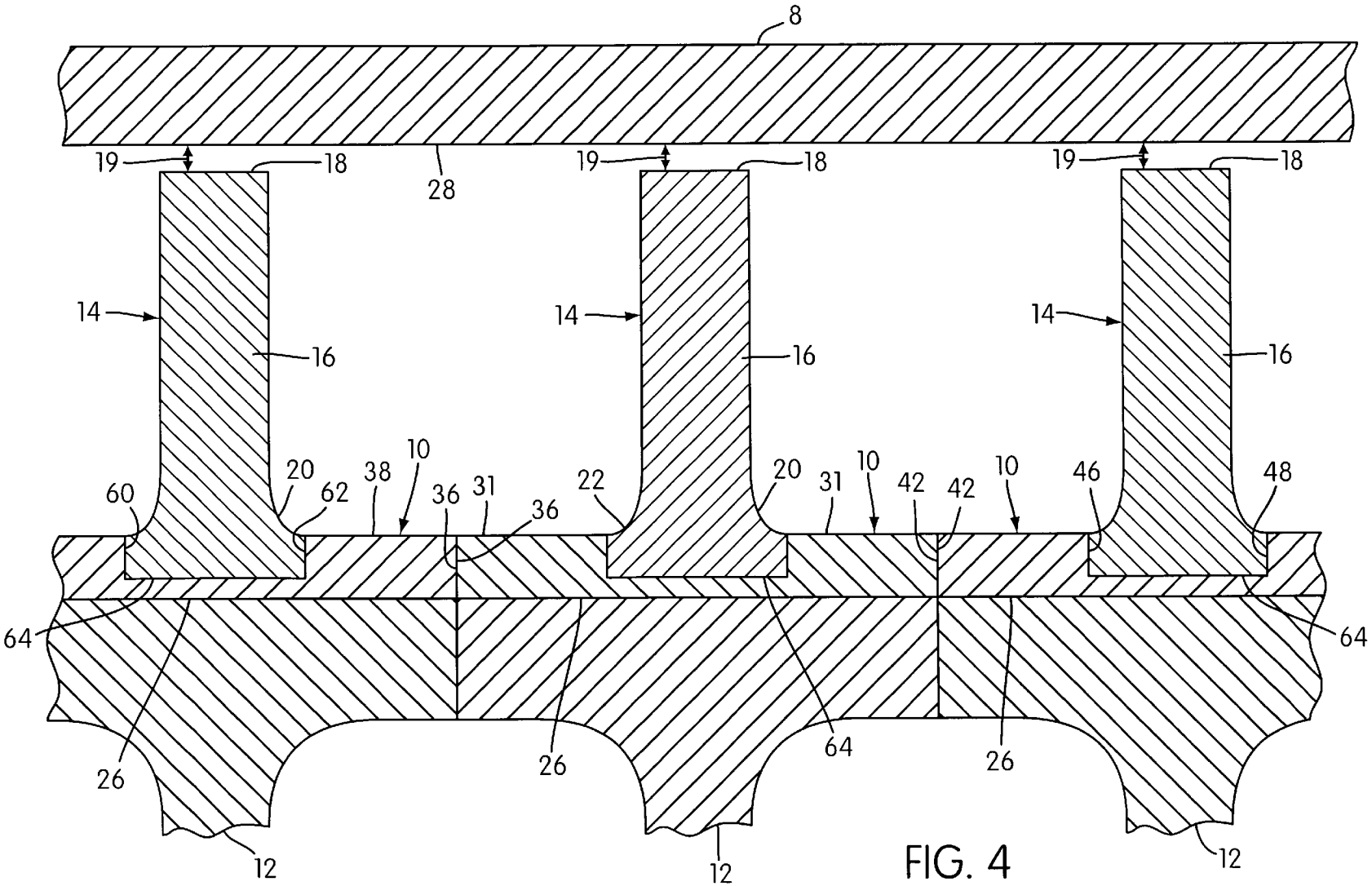
FIG. 4 is a schematic partial sectional view of FIG. 1 illustrating a plurality of spacer cartridges of FIG. 1, airfoil, and rotor blade dovetail portion being retained in the spacer cartridge with the side of a rim of adjacent compressor stages removed to reveal the spacer cartridges in the stages.

Referring to FIGS. 3 and 4, each rotor blade 14 comprises an airfoil 16 having a radial tip 18 at the outermost end and a root 20 having a dovetail portion 22 for mounting attachment to the rotor wheel. A peripheral rim 24 of rotor wheel 12 includes a plurality of slots 26, having a cross-sectional dovetail profile with a rounded bottom geometry. Rotor blades 14 are secured in the rim 24 of the rotor wheel by being received into blade dovetail retaining portions that are integrally formed with spacer cartridges 10 for engagement in slots 26. The slots are designed for mating and sliding engagement of the spacer cartridges and the rotor blades. As shown in FIG. 4, spacer cartridges 10 are advantageously designed to maintain a radial tip clearance 19 between rotor blades 14 and an interior surface 28 of compressor case 8 during operation of the gas turbine engine. For ease of explanation, the relationship of one compressor stage as it relates to a spacer cartridge in a slot of the rotor wheel will be described. As referred to herein the term radial or radial orientation is used with respect to the center of rotor wheel 12.

FIG. 2 illustrates a perspective view of an embodiment of the spacer cartridge of the present invention. Each spacer cartridge 10 of a given rotor wheel 12 is substantially identical except for some minor customization. The spacer cartridge can be constructed from materials typically used in compressor stages, such as stainless steel and alloys thereof. The spacer cartridge can be generally formed by extruding or casting the stainless steel in the shapes as described below.

Spacer cartridge 10 comprises a spacer body 30 and a blade retaining portion, area, pocket, or notch 32 integrally formed in the body. Spacer body 30 comprises a slot engaging portion 34 having a complementary mating dovetail shape that engages and interlocks with slot 26 of rim 24. As can be seen in FIGS. 3 and 4, the slot engaging portion of spacer body 30 entirely fills slot 26 to reduce the probability of backflow of air causing slot leakage that can negatively effect radial tip clearance control. Spacer body 30 also comprises a spacer portion 33 having spacer members 31 disposed on opposing sides of the blade retaining pocket.

Spacer body 30 further comprises opposing free surfaces 36, outer surfaces 38 and a bearing surface 40. Free surfaces 36 are located at the longitudinal free ends 42 of spacer cartridge 10. In addition, the free surfaces are located on each spacer member, respectively. Opposing free surfaces 36 are planar and are disposed substantially parallel to one another. If desired, free surfaces 36 can have a small angular arrangement with respect a radial axis for mating engagement with an adjacent spacer cartridge 10. The angle contributes to reduce slot leakage between abutting adjacent spacer cartridges.

Figure 5:
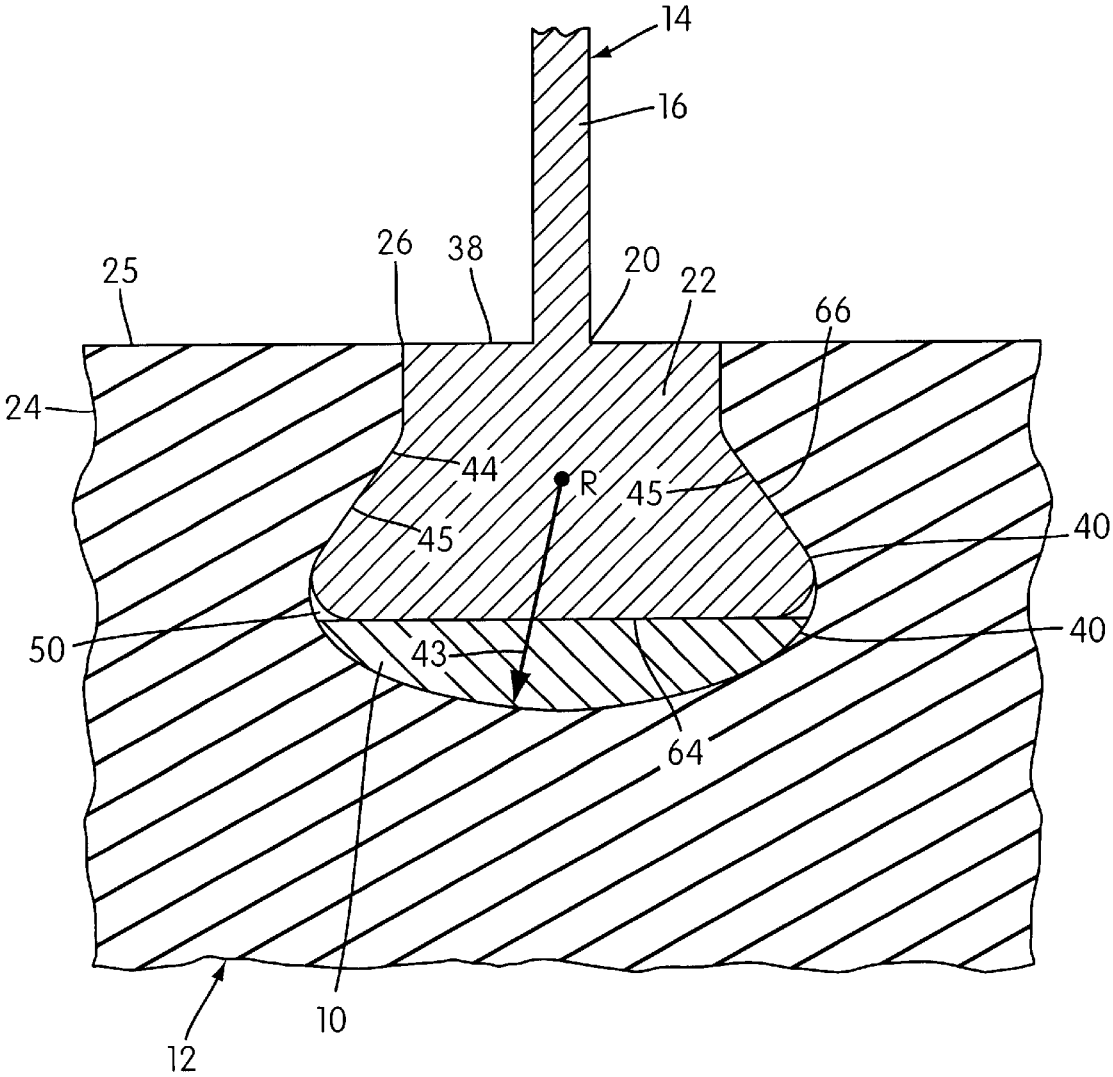
FIG. 5 is a schematic partial sectional view of the rotor blade dovetail portion, spacer cartridge, and rim of the rotor wheel at a retaining pocket of the spacer cartridge of the compressor stage of FIG. 3.

As best seen in FIGS. 3 and 5, outer surface 38 is exposed to air in the flowpath of the compressor rotor, and is substantially flush with the peripheral outer surface 25 of rotor wheel 12. This flush configuration substantially prevents air from being directed in the slots and causing slot leakage. The outer surfaces form an upper part of the spacer members. Referring to FIGS. 2 and 5, when spacer cartridge 10 is installed in slots 26, bearing surface 40 of the spacer cartridge abuts against a complementary inner surface 44 of slots 26. Bearing surface 40 extends longitudinally between opposing free surfaces 36. When the compressor rotor is operating, a centrifugal force is developed in the compressor stage. Bearing surface 40 absorbs a portion of the stress incurred by abutting against inner surface 44.

Turning to FIG. 2, spacer cartridge 10 further comprises blade retaining pocket 32 integrally formed with the body and configured to retain and secure the dovetail portion of rotor blade 16. Blade retaining pocket 32 is formed by removing a desired amount of material from spacer body 30 by a machining operation, or the spacer cartridge may be formed so that blade retaining pocket 32 is integrally casted or otherwise worked into spacer body 30. In the illustrated embodiment, blade retaining pocket 32 is disposed at an equal distance between longitudinal free ends 42 or approximately in the center portion of spacer body 30. As described later in an alternative embodiment, the spacer cartridge is not limited to a centrally disposed pocket 32.

Pocket 32 comprises opposing planar sidewalls 46, 48 and a platform surface 50 that are adapted to mate with abutting complementary surfaces of dovetail portion 22 of rotor blade 14. Sidewalls 46, 48 from exterior edges 52, 54 where they intersect with outer surface 38. Sidewalls 46, 48 also include internal edges 56, 58 that are formed from the intersection of platform surface 50. Nevertheless, platform surface 50 extends between internal edges 56, 58 of sidewalls 46, 48 and is disposed substantially perpendicular to the sidewalls.

With reference to FIGS. 2 and 5, platform surface 50 serves as a landing area of the bottom portion of the dovetail portion. If desired, the sidewalls can be substantially parallel to one another. It should be recognized that the sidewalls, and platform surface can be planar, non-planar, or any other configuration adapted to mate with the dovetail portion of rotor blade 14. In this manner, rotor blade 14 is securely mounted to rotor wheel 12 by engagement with spacer cartridge 10. As shown in FIGS. 3 and 4, a series of rotor blades are thus engaged in a series of neighboring spacer cartridges which serve to attach the rotor blades to the wheel and space them apart an appropriate distance. Using the integral spacer cartridge instead of conventional separate spacer block saves time and cost in assembly and provides significantly improved engagement to prevent slot leakage.

Referring to FIGS. 3, 4 and 5, in one embodiment of the present invention, spacer cartridge 10 enables a rotor blade dovetail portion with a substantially flat bottom geometry to fit within a round bottom shaped of slots 26 of rotor wheel 12. The substantially flat bottom geometry is shown in FIG. 5. As can be seen in FIG. 5, the round bottom shape of the slots is formed by a radius of curvature 43 that extends between opposing inner surfaces 45 of slots 26. Opposing inner surfaces 45 extend around the rim of the rotor wheel. It should be recognize that radius of curvature 43 forms a substantially concave shape of inner surface 44 within the slots. This radius of curvature also matches the lower part of slot engaging portion 34 of cartridge 10 forming a complementary convex shape for mating engagement with the bottom portion of the slots.

Referring to FIG. 4, dovetail portion 22 of rotor blade 14 comprises longitudinally oriented opposing faces 60, 62 and a radially disposed bottom face 64 extending between the faces. When the spacer cartridge is in use, opposing faces 60, 62 mate with sidewalls 46, 48 of blade retaining pocket 32 and bottom face 64 mates with platform surface 50. The mating engagement can be achieved by an interference fit between the surfaces. Referring to FIG. 5, longitudinal faces 66 on each side of dovetail portion 22 of rotor blade 14 bears against a portion of inner surface 44 of slots 26 in the rim of wheel 12. Any mating configuration of dovetail portion 22 and blade receiving pocket 32 is deemed to be within the scope of the invention.

Spacer cartridge 10 of the present invention advantageously extends the life of the rotor blade by reducing the stresses incurred during the compressor rotor operation. This extension of life, measured in the number of operation hours, reduces the number of periodic maintenance inspections, which contributes to reducing the overall life cycle cost of a turbine engine. It has been determined through finite element analysis that the blade retaining pocket reduces airfoil vibratory fatigue and induced stresses. Pocket 32 of spacer cartridge 10 provides a stiffening structure to the dovetail portion of the rotor blade 14. This stiffening structure is provided by the sidewalls, and platform surface in conjunction with the mass of the spacer cartridge.

The present invention advantageously reduces the radial and tangential motion found in conventionally installed or restrained rotor blades. The reduction in radial motion enables the radial clearance to be more constant during operation. This leads to improved efficiency and reduced operating costs by contributing to reduced fuel consumption. The reduction in motion is achieved by providing an enhanced radial engagement of dovetail portion 22 of rotor blade 14 with slots 26 and by reducing slot leakage. The enhanced radial engagement is provided by blade retaining pocket 32 forcing the dovetail portion against the inner surface of the slots. This is an improvement over prior conventional designs in which, separate spacers inserted on opposing sides of the dovetail portion provide no structure or method for radially forcing the dovetail portion against the inner surfaces of the slots.

In operation, the dovetail portion of rotor blade 14 and spacer cartridge 10 slightly expand due to thermal growth. As a secondary benefit, this thermal growth can be employed to provide a sealing method to prevent air from entering into pocket 32 and the corresponding slot on the rim. The relatively high environmental temperatures in the compressor rotor cause the dovetail portion of the rotor blade, the sidewalls, and platform surface of the pocket to expand to thereby provide a thermally induced interference fit. It should be recognized that the environmental temperatures may be recreated with the appropriate equipment to cause the desired thermal growth. Nevertheless, it should be appreciated that one of ordinary skill in the art may use various computational methods, such as finite element analysis, to determine the amount of thermal growth and accounting for factors, such as rotational speed, temperature, material characteristics, and the like.

The simplicity of installation of the spacer cartridges can be readily appreciated in the foregoing. Rotor blades 14 and spacer cartridges 10 are designed to be added to the rotor wheel by filling each of slots 26 formed in rim 24. Each rotor blade 14 is placed in pocket 32 of a spacer cartridge 10, and then the assembled cartridge and blade is slidably engaged into the respective slot. This process is repeated until all required cartridges and blades are mounted on the wheel. Advantageously, the assembly time to install the rotor blades and spacer cartridges can be reduced by approximately between 15% to 35% and preferably between 20% to 30% by eliminating the assembly of two separate spacer blocks in the conventional art. This reduction can translate into significant cost savings when applied to a large manufacturing operation. It should be recognized the approximate percentage of reduction is a function of several factors such as, manufacturing learning curves, training of personnel, and physical size of the rotor wheel.

When rotor blades 14 and spacer cartridges 10 are completely installed, the tips of the rotor blade are sized for radial clearance with respect to the compressor case. In this manufacturing step, the tips are ground to precision dimensions. Spacer cartridge 10 advantageously reduces waste by steadily and accurately holding the tip of a rotor blade outward for a tip grinding operation after the blades are mounted on the rotor wheel.

Spacer cartridge 10 also increases the efficiency of operations by reducing overhead costs for the number engineering drawings, and warehousing of fewer parts. The spacer cartridge can serve as a retrofitting device in which case significant cost savings are gained by eliminating the retooling of manufacturing operations when a manufacturer migrates to different types of rotor wheels and desires to maintain existing rotor blade configurations. Advantageously, spacer cartridge 10 can eliminate the discarding of flat bottom dovetails blades, if a manufacturer migrates to a rounded slot rotor wheel rim.

Figure 6:
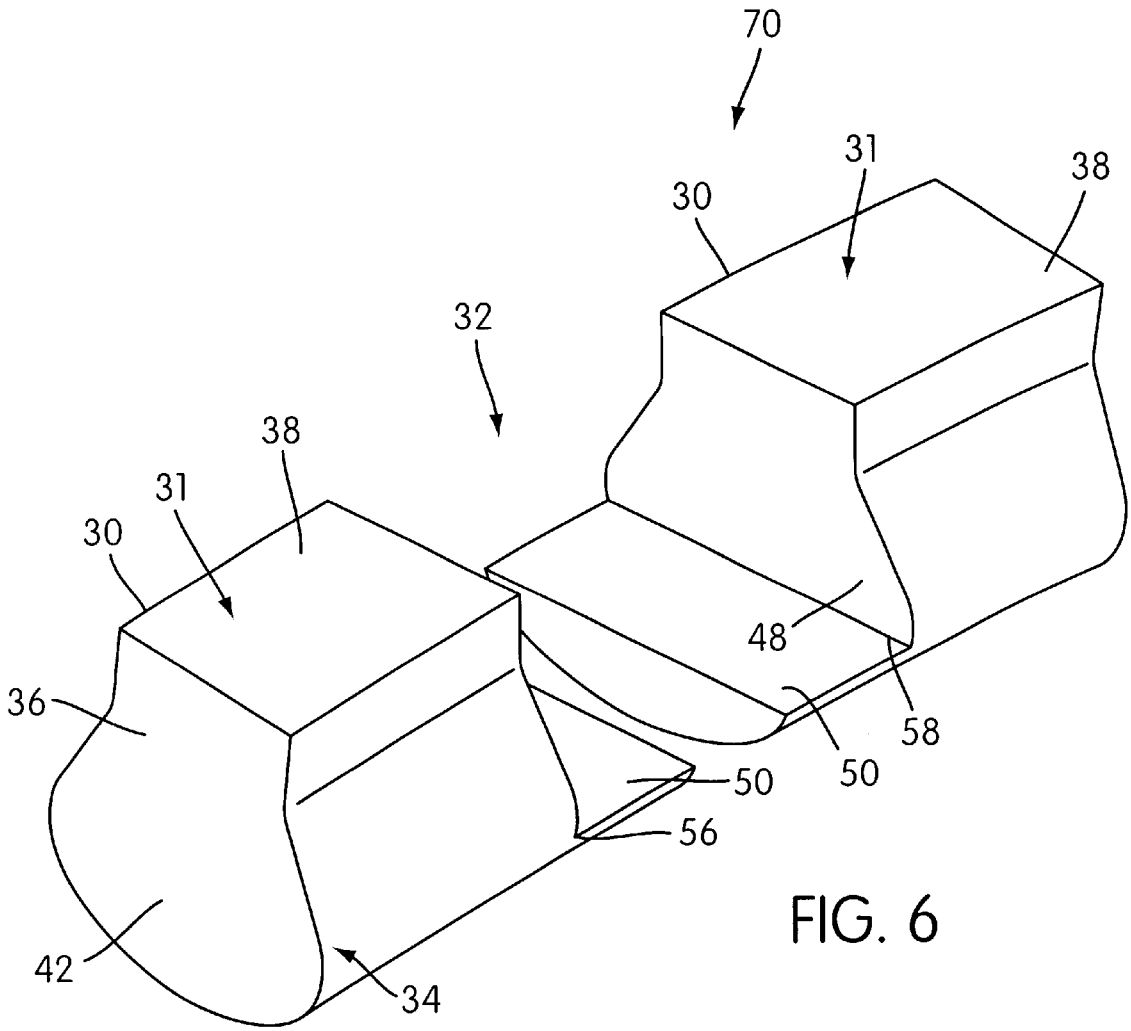
FIG. 6 is a schematic perspective view of a second embodiment of a spacer cartridge.

As illustrated in FIG. 6, it is also contemplated that neighboring or adjacent integral spacer cartridges 70 may each have blade retaining portions 32 that together retain one rotor blade when the adjacent cartridges are assembled together. This configuration may depend on a number of factors, such as rotor wheel geometry and size. In this embodiment, the function and operation of the assembled spacer cartridge functions similar as spacer cartridge 10.

Figure 7:
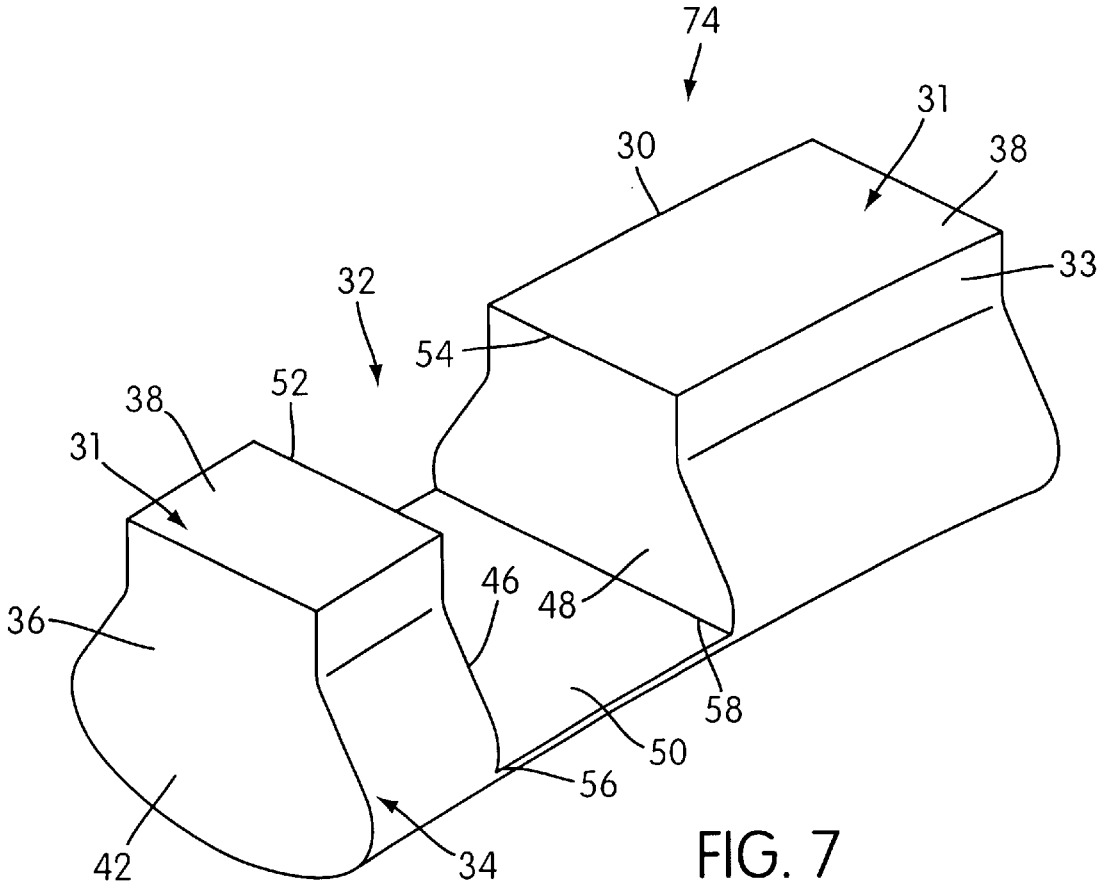
FIG. 7 is a schematic perspective view of a third embodiment of a spacer cartridge.
Figure 8:
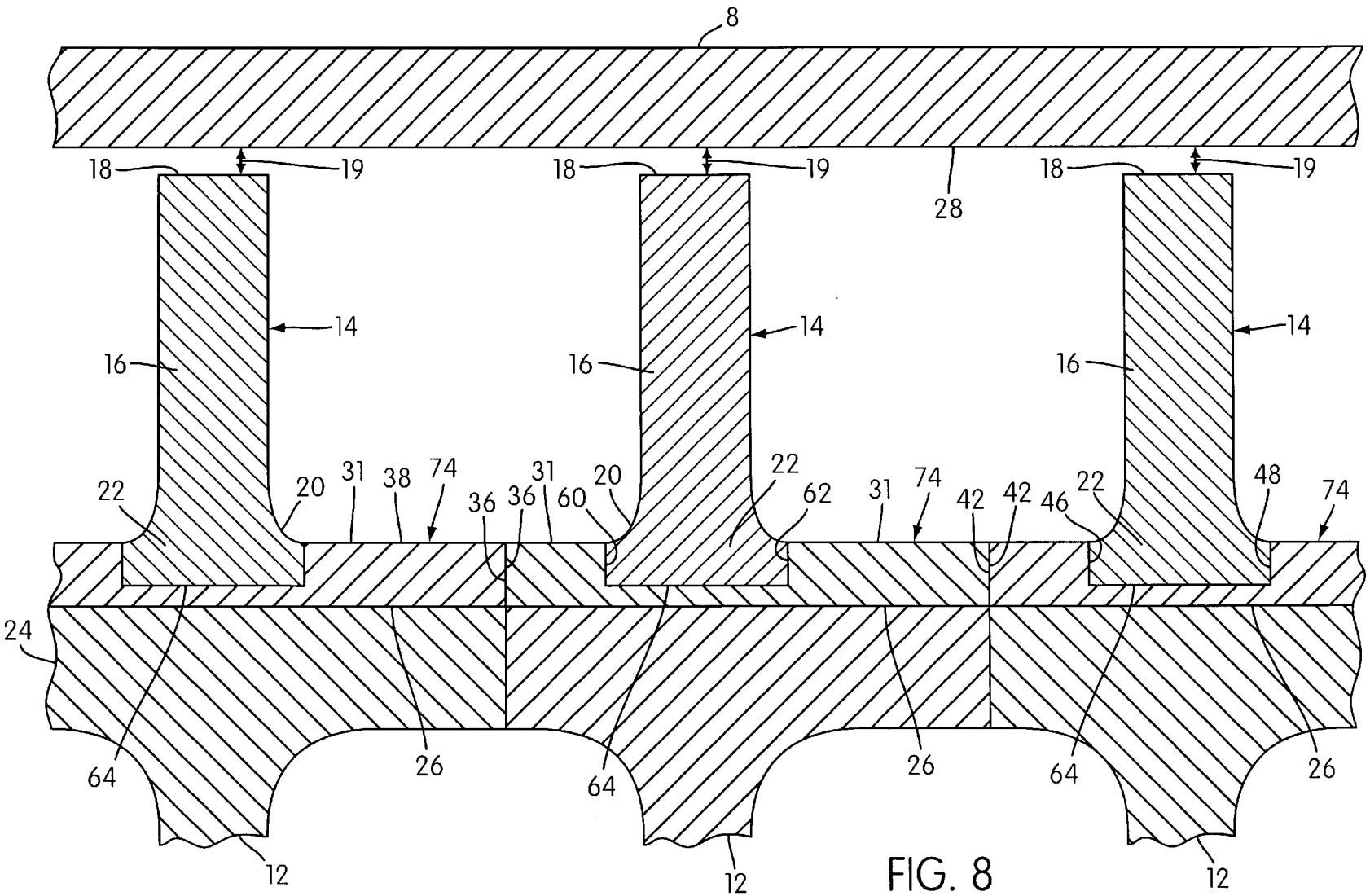
FIG. 8 is a schematic partial sectional view similar to FIG. 4 having the third embodiment of the spacer cartridge assembled in the abutting compressor stages.

While the heretofore illustrated embodiments of spacer cartridge 70 disclose a generally centrally disposed blade retaining pocket, any integral arrangement of a blade retaining pocket with a spacer portion is contemplated to be within the scope of the invention. For example, referring to FIG. 7, the blade retaining area or pocket may be off-centered between longitudinal ends 42 of spacer cartridge 74. The spacer members 31 on opposing sides of the pocket have different longitudinal lengths. In an assembled arrangement, as shown in FIG. 8, the spacer cartridges 74, perform the same functions as spacer cartridge 10.

Thus, in the illustrated embodiments, an integral rotor blade spacer apparatus for a compressor broadly comprises a blade retaining portion and a spacer portion. The spacer apparatus fits within the dovetail region of the rim of a compressor rotor wheel to maintain an angular spaced relationship between the rotor blades and, simultaneously, to retain the dovetail portion of the rotor blade. Variations of how the blade retaining portion and spacer portion are arranged relative to one another and/or relative to adjacent spacer apparatuses are contemplated to be within the scope of this invention. The spacer apparatus reduces life cycle cost by increasing the efficiency of the gas turbine engine and reducing assembly time during both initial assembly and subsequently inspections and overhaul operations. In addition, while the illustrated embodiments have been described with respect to a compressor rotor, if desired, the present invention may be used in a broad range of assemblies of blades or other similar functional radial elements spaced on a wheel or disk in turbomachinery.

While the present invention has been described with reference to preferred and exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed, but that the invention will include all embodiments falling within the scope of the appended claims.

What is claimed is:

1. A spacer cartridge for retaining a compressor rotor blade and maintaining a spaced relationship between adjacent compressor rotor blades of a rotor wheel for a gas turbine engine, said cartridge comprising:

a body having a blade retaining portion and a spacer portion, said body having a dovetail portion for mating engagement with a slot on the rotor wheel.

2. The spacer cartridge of claim 1, wherein said spacer portion comprises two spacer members defining said blade retaining portion therebetween.

3. The spacer cartridge of claim 2, wherein said blade retaining portion comprises opposing sidewalls and a landing surface extending between said sidewalls for reception of a rotor blade dovetail therein.

4. The spacer cartridge of claim 1, wherein said dovetail portion comprises a rounded geometry having a substantially convex shape for mating engagement with an inside surface of the slot, said inside surface having a substantially concave shape within the slot on the rotor wheel.

5. The spacer cartridge of claim 4, wherein the blade retaining portion includes a substantially flat landing surface adapted to mate with a rotor blade dovetail having a substantially flat bottom geometry.

6. A rotor wheel assembly for a compressor of a turbine engine, said rotor wheel assembly, comprising:

a rotor wheel having a plurality of slots in the periphery thereof;

a plurality of spacer cartridges each having a blade retaining cavity, and a slot engaging portion for thermal sealing engagement with the slots, said spacer cartridges assembled in the slots; and a plurality of rotor blades corresponding to the number of blade retaining cavities, each of said rotor blades being engaged in one of said blade retaining cavities and maintained in spaced relation from neighboring rotor blades;

wherein each spacer cartridge includes an outer surface being substantially flush with a peripheral surface of the rotor wheel and opposing free surfaces located at longitudinal ends of each spacer cartridge.

7. The rotor wheel assembly of claim 6, wherein the slot engaging portion includes a rounded geometry formed by a radius of curvature mating between an inner surface of the corresponding slots.

8. The rotor wheel assembly of claim 7, wherein a dovetail portion of each rotor blade includes a flat bottom geometry.

9. The rotor wheel assembly of claim 6, wherein the cavity of each spacer cartridge is defined by opposing sidewall surfaces extending from the outer surface and a platform surface extending between the sidewall surfaces.

10. The rotor wheel assembly of claim 6, wherein each spacer cartridge includes a bearing surface on the slot engaging portion extending between the longitudinal ends, the bearing surface abutting to a portion of an inner surface of the corresponding slots in the periphery of the rotor wheel.

11. The rotor wheel assembly of claim 6, wherein the dovetail portion of each rotor blade includes a longitudinal face for bearing against a portion of the inner surface of the slot in the periphery of the rotor wheel.

12. A rotor wheel assembly for a compressor of a turbine engine, said rotor wheel assembly, comprising:

a rotor wheel having a plurality of slots in the periphery thereof;

a plurality of spacer cartridges each having a blade retaining cavity, and a slot engaging portion for engagement with the slots, said spacer cartridges assembled in the slots; and a plurality of rotor blades corresponding to the number of blade retaining cavities, each of said rotor blades being engaged in one of said blade retaining cavities and maintained in spaced relation from neighboring rotor blades;

wherein the slot engaging portion includes a rounded geometry formed by a radius of curvature mating between an inner surface of the corresponding slots, a dovetail portion of each rotor blade includes a flat bottom geometry, and each spacer cartridge includes an outer surface being substantially flush with a peripheral surface of the rotor wheel and opposing free surfaces located at longitudinal ends of each spacer cartridge.

13. The rotor wheel assembly of claim 12, wherein the cavity of each spacer cartridge is defined by opposing sidewall surfaces extending from the outer surface and a platform surface extending between the sidewall surfaces.

14. The rotor wheel assembly of claim 13, wherein each spacer cartridge includes a bearing surface on the slot engaging portion extending between the longitudinal ends, the bearing surface abutting to a portion of an inner surface of the corresponding slots in the periphery of the rotor wheel.

15. The rotor wheel assembly of claim 14, wherein the dovetail portion of each rotor blade includes a longitudinal face for bearing against a portion of the inner surface of the slot in the periphery of the rotor wheel.

16. A compressor assembly for a turbine engine, comprising:

a plurality of rotor wheels having a plurality of slots formed in the periphery thereof;

a plurality of rotor blades, each rotor blade having a rotor blade tip and a dovetail portion; and a plurality of integral cartridges having a cavity portion retaining the dovetail portion of each of the rotor blades mounted therein, the integral cartridges having a dovetail component being mounted in the slots of the periphery of the rotor wheel for maintaining a spaced relationship between adjacent rotor blades and the dovetail component for making substantial fluid sealing engagement with said slots.

17. The compressor assembly of claim 16, wherein the dovetail component includes a rounded bottom geometry for mounting in the slots of each rotor wheel.

18. The compressor assembly of claim 17, wherein the cavity portion of each of the integral cartridges includes a platform surface that mates with the dovetail portion of each rotor blade having a flat bottom geometry.

19. A spacer cartridge for retaining a compressor rotor blade and maintaining a spaced relationship between adjacent compressor rotor blades of a rotor wheel for a turbine engine, said cartridge comprising:

a body having a blade retaining cavity being defined by a first spacer portion and an opposing second spacer portion, the first spacer portion and the second spacer portion being configured to abut together in an axial relation in a slot of a rotor wheel, the first spacer portion and the second spacer portion defining a dovetail portion of the body configured for substantially preventing a fluid to enter the slot of the rotor wheel when the first spacer portion and the second spacer portion is engaged therein.

20. The spacer cartridge of claim 19, wherein at least one of the first spacer portion and the second spacer portion includes an outer surface configured to be substantially flush with a peripheral surface of the rotor wheel.

21. The spacer cartridge of claim 19, wherein said blade retaining cavity includes a landing surface configured to abut a root of the rotor blade, the landing surface being defined by the first spacer portion and the second spacer portion when said portions are in said abutting relation.

* * * * *